United States Patent [19]

Verheyen

[11] Patent Number: 4,781,313

[45] Date of Patent: Nov. 1, 1988

[54] CONTAINERS

[75] Inventor: Willy Verheyen, Berchem, Belgium

[73] Assignee: Monsanto Company, St. Louis, Mo.

[21] Appl. No.: 88,322

[22] Filed: Aug. 24, 1987

Related U.S. Application Data

[63] Continuation of Ser. No. 803,265, Nov. 29, 1985, abandoned.

[30] Foreign Application Priority Data

Dec. 5, 1984 [GB] United Kingdom ..... 8430754

[51] Int. Cl.[4] ..... B67D 5/60

[52] U.S. Cl. ..... 222/464; 222/566

[58] Field of Search ..... 222/464, 566, 537, 564, 222/188, 152, 207, 211, 488, 571

[56] References Cited

U.S. PATENT DOCUMENTS

| | | | |
|---|---|---|---|
| 1,991,720 | 2/1935 | Barreda et al. | 222/464 |
| 2,631,608 | 3/1953 | Rosenberg | 222/464 |
| 3,178,081 | 4/1965 | Adams | 222/464 |

*Primary Examiner*—Joseph J. Rolla
*Assistant Examiner*—Kenneth Noland
*Attorney, Agent, or Firm*—James C. Bolding; Frank D. Shearin

[57] ABSTRACT

Disclosed herein is a container having an improved pouring spout for easing the passage of air into the container as a liquid is poured from the container.

7 Claims, 3 Drawing Sheets

CONTAINERS

This is a continuation of application Ser. No. 803,265, filed Nov. 29, 1985, now abandoned.

This invention relates to containers, and particularly to containers comprising means for improving the regularity of flow of liquids poured from such containers.

It is known to provide containers with devices intended to facilitate pouring of liquid contents, for example a variety of designs for spouts have been proposed, and it is also known to provide such spouts with venting channels enabling the admission of replacement air into the container with a view to reduce the "gulping" or "gobbling" effect by which the liquid exits the container in irregular spurts. Such a vented spout has to be used with the vent always uppermost, however, and it cannot be conveniently incorporated into the container closure without special measure being necessary to bring it into action. Although removable spouts or folding or telescopic spouts have all been used at one time or another, they suffer from the disadvantage that some action by the user is necessary when they are brought into operation and again when they are put away.

There has now been developed a new device of simple construction for incorporating into an outlet of a container for a liquid, whereby the regularity and overall rate of flow of liquid from the container can be greatly improved. It does not need any special action on the part of the user nor any special precautions when pouring. Being, in its preferred construction located entirely within the container, it does not detract from the appearance or stackability of the container nor does it interfere with closures such as screw caps. It cannot be lost, as is the case with detachable spouts. On the other hand, an external spout can be used in conjunction with the device if desired.

The invention comprises container for a liquid, having an opening which liquid can be poured from the container, and comprising an outlet flow-regulating device comprising a tube extending from the vicinity of the opening into the interior of the container and open at both ends whereby, when liquid is poured from the container the liquid and replacement air flow through the tube in opposite directions, and the wall of the tube having therethrough a plurality of apertures for the passage of air from inside the tube to the interior of the container.

The invention also comprises an outlet flow-regulating device as defined above. An example of a container according to the invention will now be described with reference to the accompanying Drawings, in which.

Figure 1:
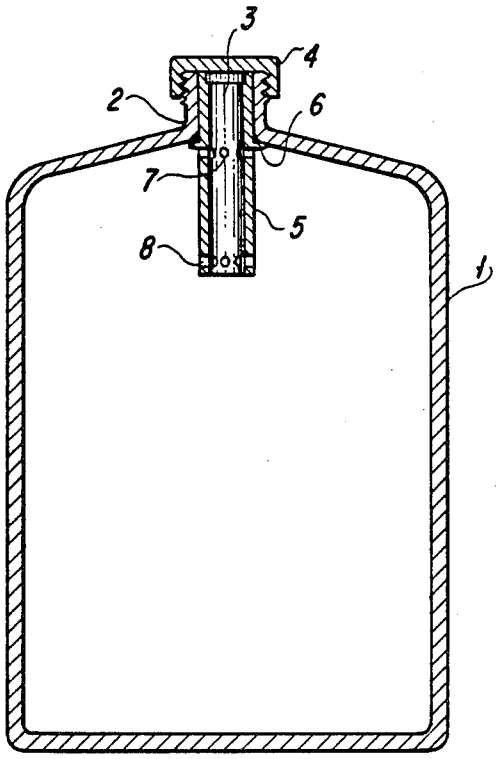
FIG. 1 is a section of the container.
Figure 2:
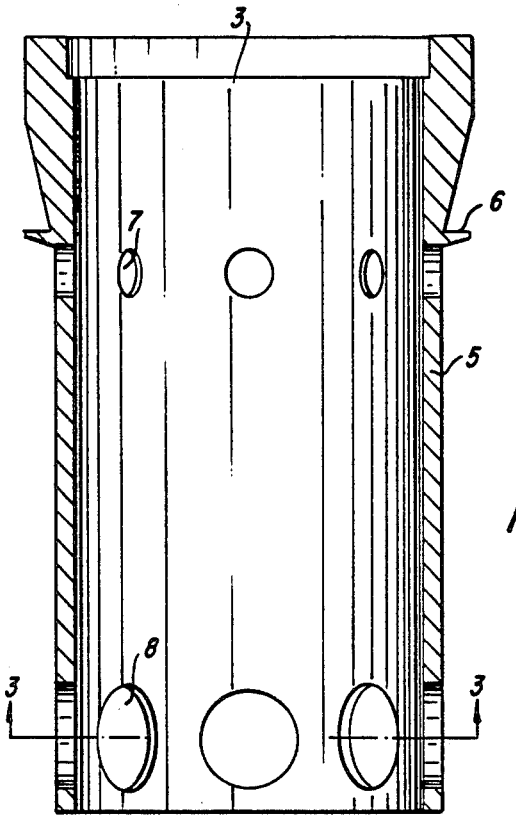
FIGS. 2 and 3 are cross sections of a flow-regulating tube.
Figure 3:
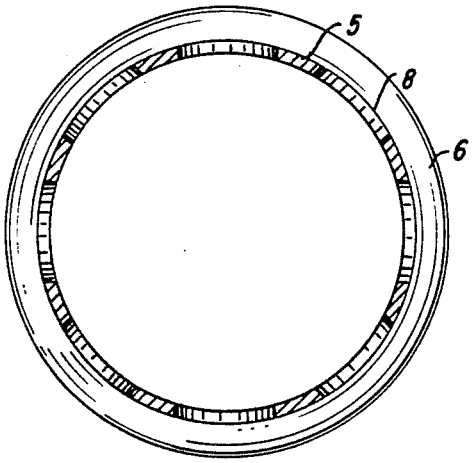

As shown in FIGS. 1, 2 and 3, the container has a wall (1), and a neck (2) having an outlet opening (3). The outside of the neck has a screw thread to accept a closure cap (4). Fitted within the neck (2) is a cylindrical tube of circular cross-section (5) open at both ends and extending into the interior of the container. The tube has its wall thicknened at its outlet and so that it is a close frictional sealing fit inside the neck, and a circumferential retaining rib (6) assists in retaining the tube in position. The wall of the tube is pierced by apertures (7) and (8) arranged in two circumferential rows as shown, row (7) being situated adjacent to the junction between container wall (1) and neck (2) and row (8) being situated near the end remote from the opening.

Figure 4:
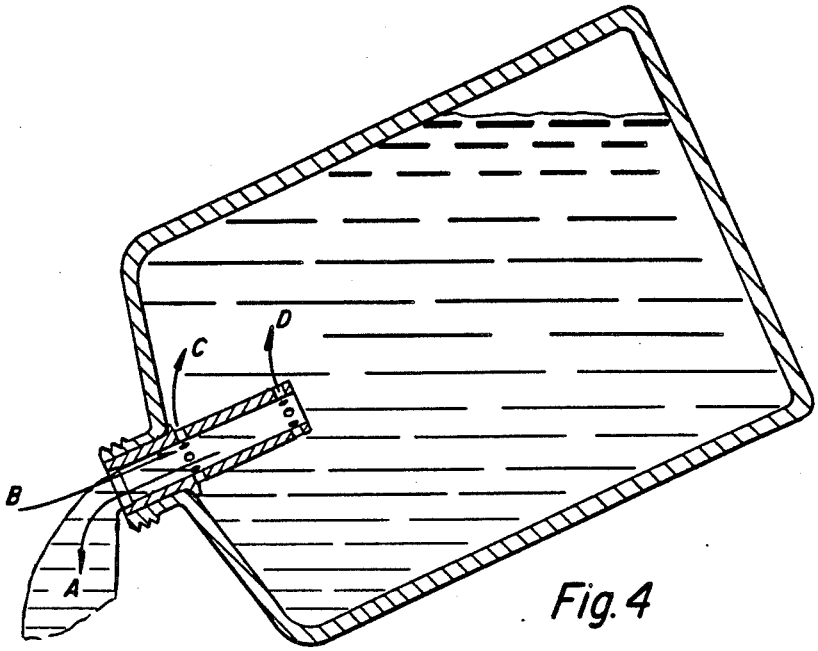
FIG. 4 is a view, partly in cross-section, showing the action of pouring liquid from the container.

In FIG. 4, the container is shown nearly full of liquid in the pouring position. Liquid flows out in the direction of arrow (A) whilst air flows in to the container as shown by arrow (B). Arrows (C) and (D) show the flow of air through apertures (7) and (8) respectively. The liquid flow is almost completely uniform, with only low amplitude pulses of comparatively high frequency.

Some experimentation is normally necessary when choosing dimensions of the tube and its apertures. Sometimes, the cross-section of the tube is predetermined by that of the container's outlet opening, although it is more usual for the container and its flow-regulating tube to be designed together. In any event, the cross-sectional area of the tube needs to be sufficient for both the poured liquid and displacement air to flow through it in countercurrent at the desired rate. Where (as is often likely to be the case) the outlet aperture and the tube are circular in cross-section, a diameter of between 1.5 and 10 centimeters is usually suitable while diameters between 3 and 7 centimeters are preferred. The cross-section of the tube may change along its length if desired; however there is not usually any reason why this should be preferred over tubes of unvarying cross-section. The chosen length of the tube within the container is preferably more than its diameter at the end remote from the outlet, or major cross-sectional dimension where it is not of circular cross-section. A length of from 1.2 to 7 times this dimension is usually suitable with 1.5 to 5 times being preferred in most instances and 2 to 3 times being very often most suitable.

The shape and size of the individual apertures and their number is also related to the same major cross-sectional dimension of the tube. The apertures need not all be the same size. In general, individual apertures preferably have a circular shape and diameter from 3 to 20 millimeters, preferably 4 to 12 millimeters although other shapes, regular or irregular, such as square or rectangular for example can be employed. Preferably, however, the ratio of the maximum to minimum dimension of at least the majority of the individual apertures is not greater than 3. If desired, apertures at the end of the tube remote from the outlet can consist of notches in the end of the tube wall. However, this does not give such good results as apertures near the end of the tube that are completely bounded by the material of the tube wall.

The number of apertures is preferably such that their total area represents from 5 to 30% of the total wall area including aperture area of the tube within the container, more preferably this proportion is from 7 to 20%. They are preferably arranged in two groups, one group being adjacent to the junction between the tube and the container wall and the other group being further along the tube for example near the end remote from the outlet. Preferably the apertures in the former group are smaller than those in the latter group. The apertures in each group are preferably spaced around the circumference of the tube so that there is no need to hold the container in any particular orientation when pouring. Preferably there are at least 4 apertures in each group with from 6 to 12 being a preferred number. Very often it is convenient to have 8 apertures in each group arranged equidistantly around the tube.

If desired, the container may have a temporary closure, such as a sealing plug or diaphragm over its outlet (in addition to any main closure) to prevent unauthorised interference with the contents. Since this temporary seal must be removed by the user, it is not considered to detract from the requirement for the tube to be open at both ends. It can in fact be unitary with the tube.

The invention is particularly applicable to containers of comparatively large capacity, for example 5 liters or more, especially 10 liters, 20 liters or even more. The gobbling problem is normally more acute with such containers than with small ones. It can also be more of a problem where the liquid in the container is comparatively viscous (for example 20 to 1000 cPs) such as for example an oil, a paint or an adhesive. It has been found to be especially valuable for use in containers of the glyphosate herbicide liquid concentrate sold by Monsanto under the registered Trade Mark "Roundup".

The container and the flow-regulating device can be made of any material conventionally used, for example plastics materials such as polyethylene, polypropylene or ABS; rubbers; or metals such as steel, tin-plated steel or aluminium. Such materials are of course chosen with due regard to their strength, the need to avoid contamination of the liquid contents or corrosion by the contents or atmosphere. Polyethylene is often a suitable material.

EXAMPLE

This Example describes a container comprising a flow-regulating device according to the invention and demonstrates the improvement obtained over a container without the device and a container having a previously known vented spout.

The container, having a normal capacity of 20 liters (actually 21.5 liters). was made of low-density polyethylene and was shaped generally as shown in FIGS. 1 of the Drawings. It was fitted with a flow regulating device as shown in FIGS. 1, 2 and 3. The flow-regulating tube was a cylinder of circular cross-section with an internal diameter of 35 mm and a total length of 75 mm. The length projecting from the neck inside the container was 55 mm. The apertures were arranged in two groups as shown in FIGS. 2 and 3. Each group of apertures consisted of eight apertures spaced equidistantly around a circumference of the tube, those in one group being adjacent to the container neck and each having a diameter of 5 mm, and those in the other group each having a diameter of 10 mm. The centers of the latter were 7 mm from the lower end of the tube.

The container was filled with 20 liters of a liquid having a viscosity 0.05 Pa.s. and poured out through the device. Pouring was very easy, being almost completely uniform with only low amplitude pulses of comparatively high frequency (3 to 10 Hz) as compared with tests carried out in the absence of the flow-regulating tube. In the latter, severe "gobbling" pulses of frequency 0.3 Hz occurred.

Figure 5:
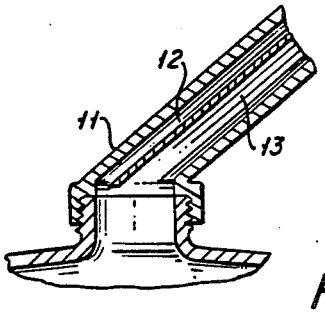
FIG. 5 is a cross-section of the neck part of a container having a known vented pouring spout.

Another comparative test was performed using the vented spout shown in FIG. 5. This spout (11) had a vent tube (12) for the inflow of air, the liquid flowing out through the main tube (13). The liquid came out of the spout in large amplitude pulses of frequency about 0.5 Hz, leading to spillage and a slow overall rate of delivery. Although some improvement could be obtained by careful slow pouring, any attempt to improve pouring rate (by increasing the angle at which the container was held) resulted in a recurrence of the "gobbling" problem.

I claim:

1. A container for a liquid, having an opening through which liquid can be poured from the container, and comprising an outlet flow-regulating device comprising a tube extending from the vicinity of the opening into the interior of the container and open at both ends whereby, when liquid is poured from the container, the liquid and replacement air flow through the tube in opposite directions, the wall of the tube having therethrough a plurality of apertures arranged in two groups, one group being adjacent to the junction between the tube and the container wall and the other group being near the end of the tube remote from the container outlet opening for the passage of air from inside the tube to the interior of the container, wherein the total area of the apertures is from about 7% to about 20% of the total wall area of the tube, and the length of the tube within the container being from 1.2 to 5 times the major dimension of the cross section of the tube at its end remote from the outlet opening whereby said liquid is poured from the container and replacement air enters the container without substantial interruption of said poured liquid flow.

2. A container according to claim 1, in which the tube does not project outside the container beyond the outlet opening.

3. A container according to either claim 1 or 2 in which the tube has substantially the same internal cross-section over substantially the whole of its length.

4. A container according to claim 1 in which the apertures in the former group are smaller than those in the latter group.

5. A container according to claim 4 in which the container has a capacity of about 20 liters, the tube is a cylinder of circular cross-section with an internal diameter of about 35 mm and a length of about 75 mm, each group of apertures consists of eight apertures spaced equidistantly around a circumference of the tube, those in the former group each having a diameter of about 5 mm and those in the latter group each having a diameter of about 10 mm with the centers of the latter group being about 7 mm from the end of the tube remote from the outlet opening.

6. A container according to claim 5, having a temporary closure, in addition to any main closure, to prevent unauthorised interference with its contents.

7. A device according to claim 1 having unitary therewith a temporary closure to prevent unauthorized interference with contents of the container.

* * * * *